US005513479A

United States Patent [19]

Roberts et al.

[11] Patent Number: 5,513,479

[45] Date of Patent: May 7, 1996

[54] SYSTEM FOR ENCLOSING AN OBJECT IN A PACKAGING STRUCTURE

[75] Inventors: Thomas E. Roberts, Leawood; Dennis D. Garberg; Thomas J. Butler, both of Overland Park; Lester N. Land, Parker, all of Kans.

[73] Assignee: Dennis Garberg & Associates, Inc., Overland Park, Kans.

[21] Appl. No.: 425,882

[22] Filed: Apr. 21, 1995

[51] Int. Cl.[6] ..... B65B 43/26

[52] U.S. Cl. ..... 53/459; 53/390; 53/571

[58] Field of Search ..... 53/390, 570, 571, 53/572, 459, 474

[56] References Cited

U.S. PATENT DOCUMENTS

| | | | |
|---|---|---|---|
| 1,975,404 | 10/1934 | Prucha . | |
| 2,474,025 | 6/1949 | Aspinall . | |
| 2,917,164 | 12/1959 | Kehr . | |
| 2,964,892 | 12/1960 | Grosjean . | |
| 3,429,718 | 2/1969 | Helms . | |
| 3,456,866 | 7/1969 | Civitello . | |
| 3,762,628 | 10/1973 | Sargent . | |
| 3,763,627 | 10/1973 | Kupcikevicius et al. | 53/572 |
| 3,789,570 | 2/1974 | Mullins, Jr. . | |
| 3,807,118 | 4/1974 | Pike . | |
| 3,807,122 | 4/1974 | Kihnke et al. . | |
| 3,817,448 | 6/1974 | Schneider . | |
| 3,868,807 | 3/1975 | Noyes et al. . | |
| 3,882,656 | 5/1975 | Lerner . | |
| 3,945,173 | 3/1976 | Buzzi . | |
| 3,998,135 | 12/1976 | Sargent . | |
| 4,158,943 | 6/1979 | Lack et al. | 53/459 |
| 4,172,349 | 10/1979 | Lipes . | |
| 4,201,031 | 5/1980 | Wiles . | |
| 4,256,256 | 3/1981 | Meyers . | |
| 4,268,344 | 5/1981 | Jones . | |
| 4,290,467 | 9/1981 | Schmidt . | |
| 4,291,517 | 9/1981 | Lipes . | |
| 4,341,054 | 7/1982 | Courtheoux . | |
| 4,480,750 | 11/1984 | Dancy . | |
| 4,541,226 | 9/1985 | Nausedas . | |
| 4,543,768 | 10/1985 | Nishikawa et al. . | |
| 4,567,715 | 2/1986 | Sawa et al. | 53/572 |
| 4,662,147 | 5/1987 | Scheja . | |
| 4,726,171 | 2/1988 | Kreager et al. . | |
| 4,744,673 | 5/1988 | Nakamura . | |
| 4,805,381 | 2/1989 | Hannon . | |
| 4,830,317 | 5/1989 | Kober et al. . | |
| 4,840,336 | 6/1989 | Stroh et al. . | |
| 4,936,817 | 6/1990 | Runge . | |
| 4,938,608 | 7/1990 | Espinosa . | |
| 4,945,713 | 8/1990 | Widenback . | |
| 4,981,216 | 1/1991 | Wilfong, Jr. . | |
| 4,989,732 | 2/1991 | Smith . | |
| 4,991,980 | 2/1991 | Cohen et al. . | |
| 4,993,845 | 2/1991 | Faltynek . | |
| 4,995,217 | 2/1991 | Francis, Jr. . | |
| 5,020,750 | 6/1991 | Vrooman et al. . | |
| 5,195,304 | 3/1993 | Capaci | 53/390 |
| 5,213,145 | 5/1993 | Hauang et al. . | |
| 5,228,268 | 7/1993 | Jensen . | |
| 5,249,904 | 10/1993 | Jensen . | |
| 5,290,391 | 3/1994 | Czecm et al. . | |
| 5,363,966 | 11/1994 | Czecm et al. . | |

FOREIGN PATENT DOCUMENTS

| | | |
|---|---|---|
| 2003443A | 9/1977 | Germany . |
| 2066209 | 7/1981 | United Kingdom . |

*Primary Examiner*—John Sipos
*Assistant Examiner*—Gene L. Kim
*Attorney, Agent, or Firm*—Hovey, Williams, Timmons & Collins

[57] ABSTRACT

A system for enclosing an article includes a packaging apparatus for enclosing an article in a pouch configured as part of a packaging structure having first and second ends and an opening for the pouch. The packaging apparatus includes a platform with front and rear sides and a support surface therebetween, a heat sealer and a framework for positioning the sealer forward of the platform with an open space therebetween and with an open area under the platform. In use, a bundle of packaging structures, joined at the first ends, is coupled with the platform rear side, and then extended under the support surface, around the rear side through the open space and onto the support surface with the pouch openings supported above the surface. An article is inserted in the topmost pouch through the opening which is then sealed by the sealer. Filled structures are suspended below the platform rear side until all of the pouches have been filled.

37 Claims, 4 Drawing Sheets

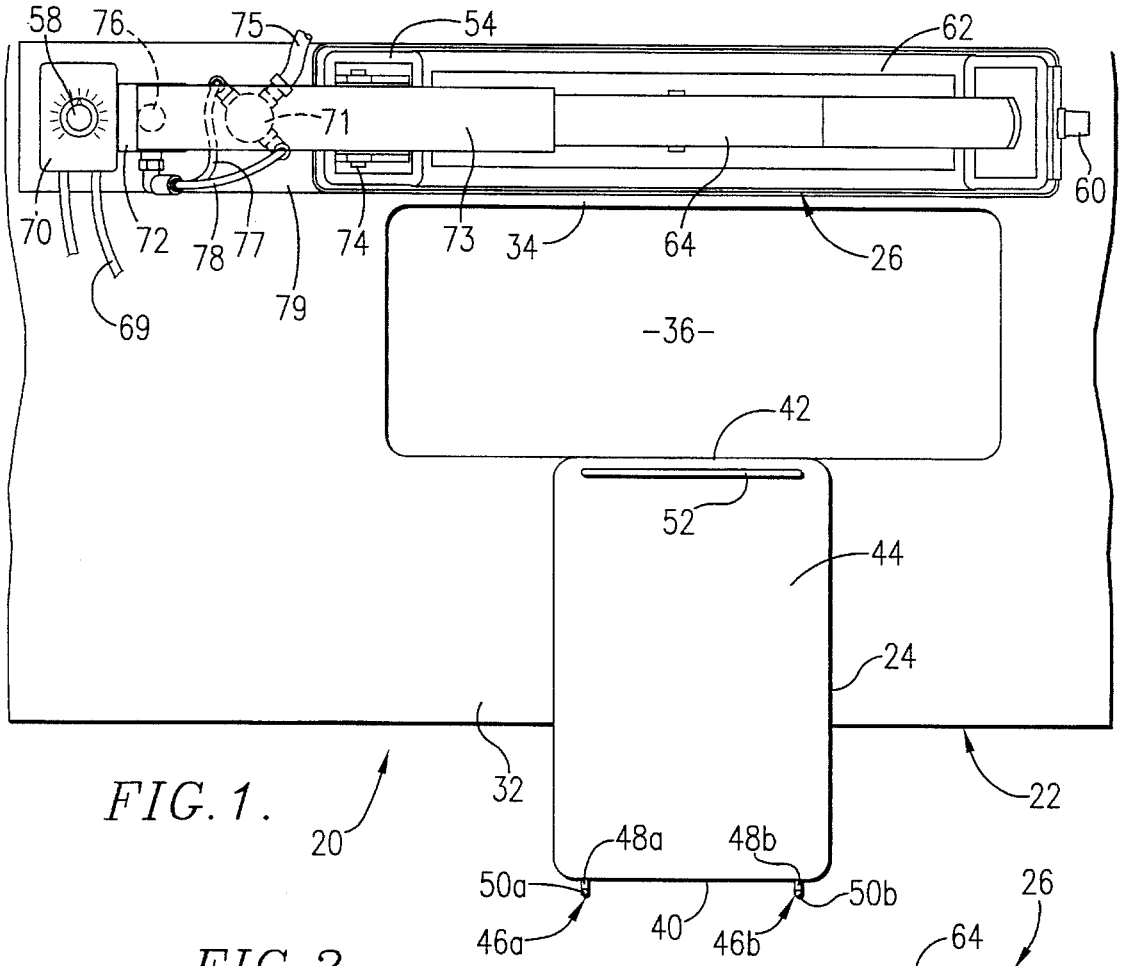
FIG. 1.
FIG. 2.
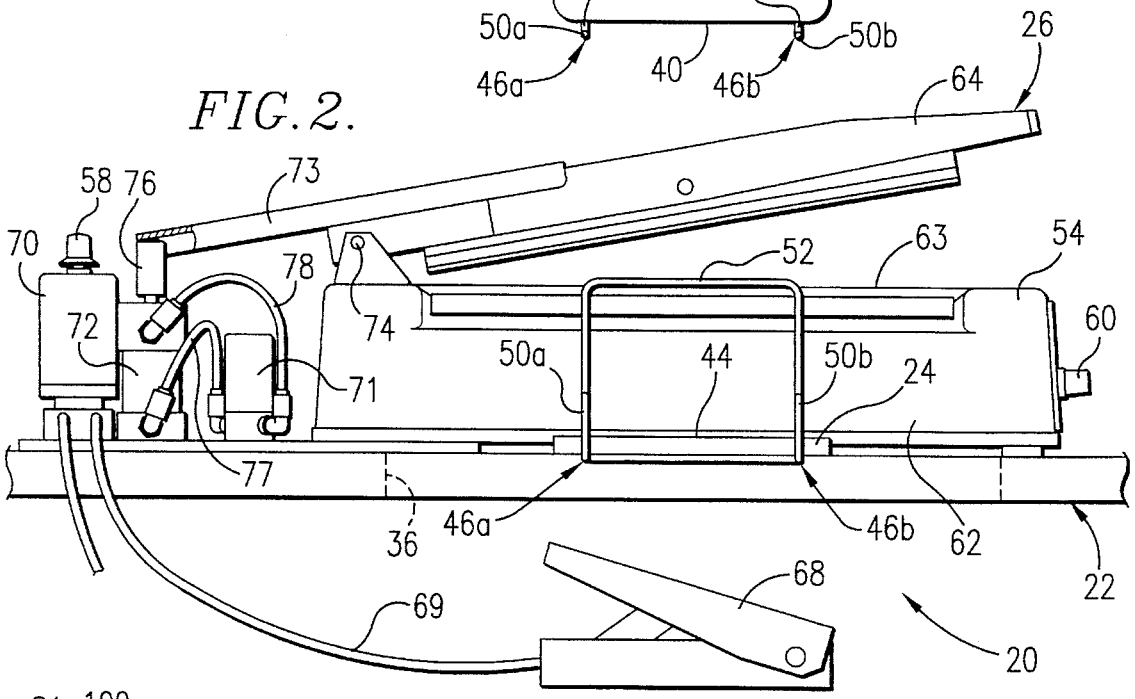
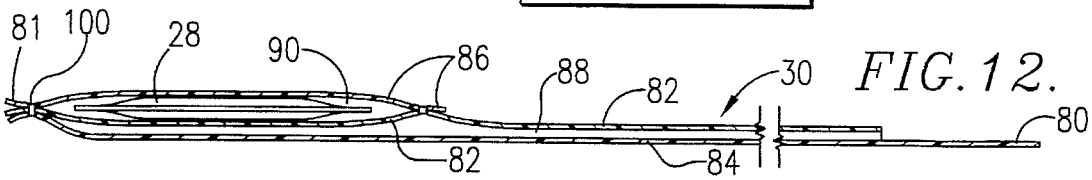
FIG. 12.

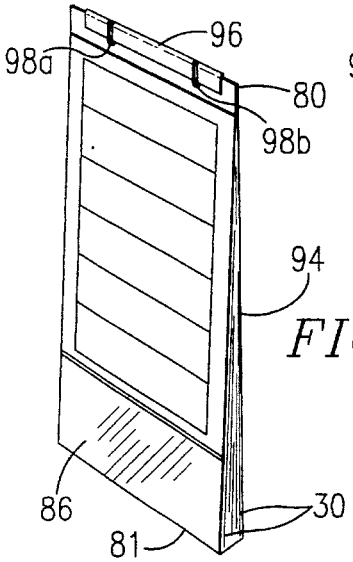
FIG. 3.
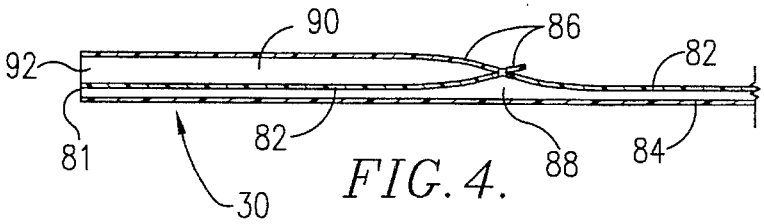
FIG. 4.
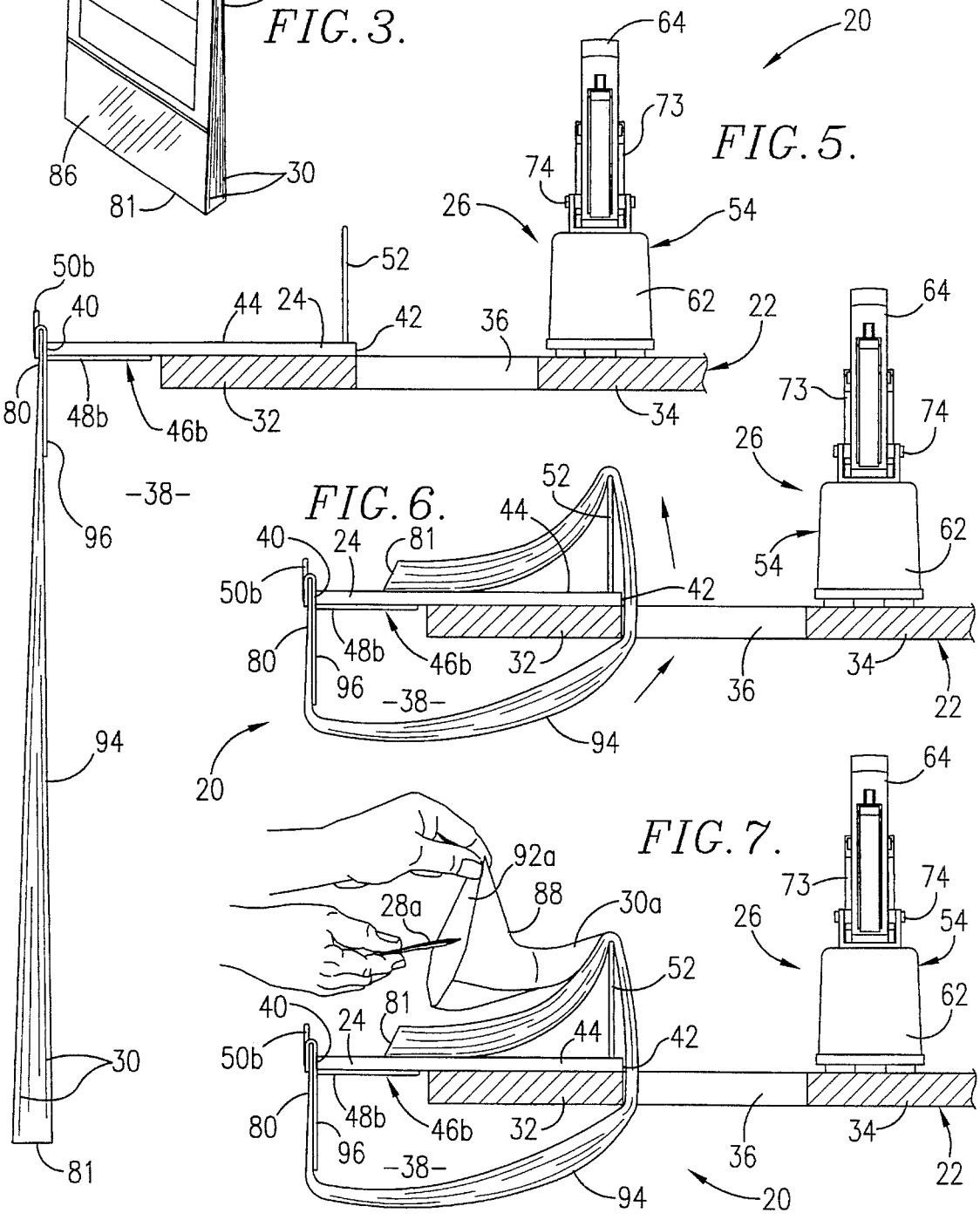
FIG. 5.
FIG. 6.
FIG. 7.

SYSTEM FOR ENCLOSING AN OBJECT IN A PACKAGING STRUCTURE

BACKGROUND OF THE INVENTION

1. Field of the Invention

The present invention relates to the field of packaging. More particularly, the invention concerns an apparatus and method for enclosing an article in a pouch configured as part of a packaging structure. The packaging apparatus includes a platform with front and rear sides and a platform surface therebetween, a heat sealer and a framework for positioning the sealer forward of the platform with an open space therebetween and with an open area under the platform.

2. Description of the Prior Art

As a marketing technique, newspapers may be delivered to subscribers in plastic bags configured to include sealed pouches enclosing merchandise samples and literature. For efficiency and security of the merchandise samples, the samples are sealed in the pouches before the bags are shipped to the newspaper delivery service. The service then inserts the newspapers into the bags for delivery to the subscriber.

In the prior art, the pouch filling process has been labor intensive and inefficient. Accordingly, the prior art points out the need for a system by which the merchandise samples or other articles can be sealed in the pouches in a manner which is cost effective.

SUMMARY OF THE INVENTION

The present invention solves the prior art problems discussed above and provides a distinct advance in the state of the art. More particularly, the system hereof allows articles to be sealed in pouches in an efficient manner.

The preferred apparatus includes a platform presenting front and rear sides and a platform surface therebetween, a sealer and a framework for positioning the sealer forward of the platform front side to present an open space therebetween and for positioning the support surface with an open area thereunder. The platform preferably includes coupling tines adjacent the rear side thereof for insertion through a packaging structure adjacent a first end thereof. The packaging structure is configured to include a pouch with an opening for insertion of an article into the pouch.

In the preferred method, the packaging structure extends around the platform front side then under the platform surface through the open area, through the open space and onto the platform surface with the pouch opening thereabove. At least one article is then inserted into the pouch through the opening which is then moved to the sealer to seal the opening.

In a particularly preferred embodiment, a bundle of packaging structures are joined adjacent the upper ends thereof and the tines inserted therethrough for coupling the bundle with the platform. With the bundle extended around the platform and over the holding member onto the platform surface, the topmost pouch is filled with one or more articles and sealed. The filled packaging structure is then positioned to hang from the tines. This process is repeated until all of the structures have been filled.

In an alternate embodiment of the preferred method, the packaging structure is placed on the platform surface in a folded orientation with both the first end and the pouch opening oriented away from the sealer. At least one article is inserted into the pouch opening, and the packaging structure is then extended so that the pouch opening may be sealed by the sealer. The portion of the packaging structure including the article or articles is then permitted to fall through the open space under the influence of gravity. The method may be repeated for a bundle of such packaging structures joined at the first end.

BRIEF DESCRIPTION OF THE DRAWING

FIG. 1 is a plan view of the preferred packaging apparatus in accordance with the present invention with a partial view of the preferred framework;

FIG. 2 is an elevational view of the preferred sealer of FIG. 1;

FIG. 3 is a perspective view of a bundle of packaging structures shown coupled with the platform of FIG. 1;

FIG. 4 is a partial side sectional view of a packaging structure of FIG. 3;

FIG. 5 is a side elevational view in partial section of the apparatus of FIG. 1 with a bundle of packaging structures suspended therefrom;

FIG. 6 illustrates the apparatus of FIG. 5 with the bundle extended around the platform;

FIG. 7 illustrates the apparatus of FIG. 5 showing the insertion of an article into the pouch of the topmost packaging structure;

FIG. 12 is a partial, side sectional view of a packaging structure with an article sealed in the pouch thereof.

DETAILED DESCRIPTION OF THE PREFERRED EMBODIMENTS

Figure 10:
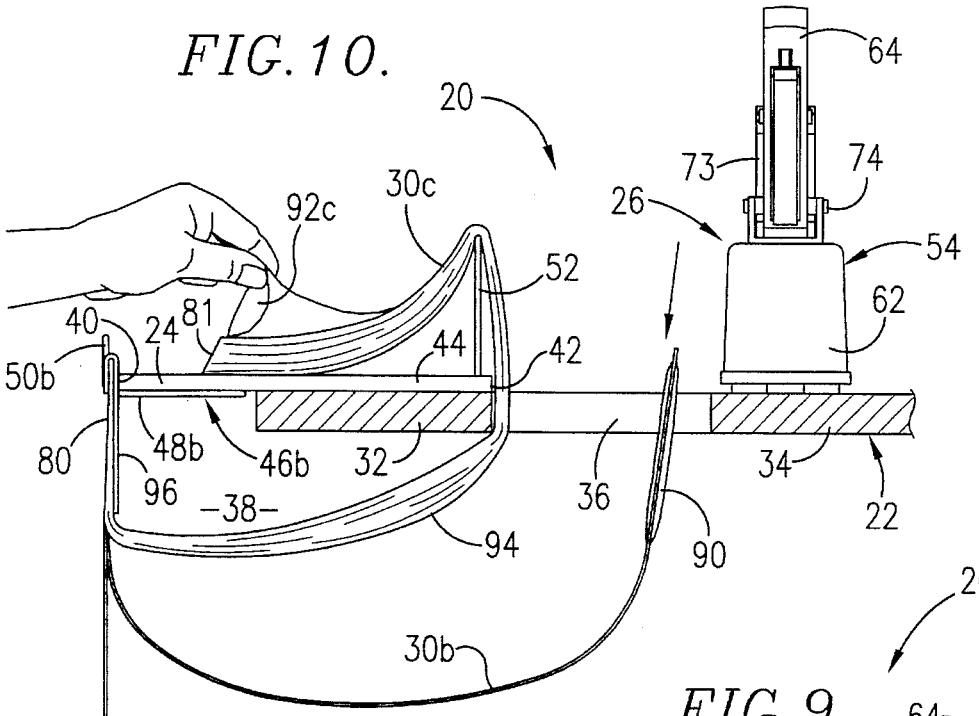
FIG. 10 illustrates the apparatus of FIG. 5 showing the suspension of the first packaging structure after sealing, completion of the sealing of second structure, and preparation for article insertion of the third structure.

Referring to the drawing figures, and in particular, FIG. 1, packaging apparatus 20 includes framework 22, platform 24 and sealer mechanism 26 for use in enclosing article 28 (See FIGS. 7 and 12) in packaging structure 30 (See FIGS. 4 and 12). Article 28 can be any object desired to be enclosed and can include such things as merchandise samples, premiums, coupons, brochures and other literature. Framework 22 is preferably in the form of a tabletop presenting rearward section 32 and forward section 34 with a preferably rectangularly shaped open space 36 therebetween. Framework 22 also presents open area 38 under rearward section 32 (See FIG. 5).

Platform 24 is coupled with framework rearward section 32 and presents rear side 40 and front side 42 with upper platform surface 44 therebetween. Platform 24 includes a pair of spaced, L-shaped coupling structures **46*a* and 46*b* presenting respective horizontal legs 48*a* and 48*b* and presenting respective upstanding coupling tines 50*a* and 50*b* spaced from platform rear side 40. It may be appreciated that other coupling structures such as tape, clamps, hooks of various configurations, or adhesive could be used to temporarily couple the packaging structure to the platform. Platform 24 also includes upright holding member 52 presenting an inverted U-shaped configuration and extending from platform surface 44 adjacent front side 42. Coupling structures 46***a,b* and holding member 52 are preferably composed of wire. As shown in FIG. 1, platform rear side 40 extends rearwardly of framework rearward section 32 and platform front side 42 is mounted flush with open space 36 as illustrated in FIG. 1.

Sealer mechanism 26 is supported on framework forward section 34 adjacent open space 36. The sealer mechanism 26 may be an impulse sealer 54, such as, for example a TEW impulse sealer Type TISH-300 available from TEW Electric Heating Co. Such impulse sealers 54 include an electrically heated, stationary anvil body 62 including heat seal strip 63, pivot arm 64, and heat dwell regulator knob 60. The heat dwell regulator knob 60 controls the length of time heat is supplied by the anvil once the pivot arm 64 is lowered to a sealing position and when used with three plys of 1.35 mil polyethylene film is typically set at about one half second. The impulse sealer 54 may be manually actuated by the operators hand depressing the pivot arm 64 into sealing position to hold the packaging structure to be sealed against the anvil body 62. An internal spring in the anvil body 62 normally biases the pivot arm 64 into the open, disengaged position shown in FIG. 2, so that the pivot arm 64 automatically opens to facilitate repeated sealing.

Most preferably, the sealer mechanism 26 also includes structure permitting time controlled foot pedal actuation. As shown in FIG. 2, the sealing mechanism also includes foot switch 68, control cable 69, time delay relay 70, pneumatic switch 71, and actuator 72. An extension bar 73 is mounted on the pivot arm 64 to extend away from the anvil body 62 and over the actuator 72. A pivot pin 74 couples the pivot arm 64 to the anvil body 62. A pneumatic conduit 75 provides a source of pressurized air at about 50 to 55 psi to the pneumatic switch. A piston rod 76 extends upwardly from the body of the actuator 72. The time delay relay 70 is electrically coupled to the pneumatic switch 71 to provide a signal to the switch. The relay 70 signals the switch 71 to direct pressurized air to either first control conduit 77 to raise the piston rod 76 to engage the extension bar 73 and lower the pivot arm 64 to the closed position, or to second control conduit 78 to lower the piston rod and permit the pivot arm 64 to rise to the open position. An exemplary time delay relay 70 is a Model 5X828F solid state time delay relay by Dayton Electric Mfg. Co. of Chicago, Ill. and is set for between 0.5 and 2 seconds and most preferably about 1 second. An exemplary pneumatic switch 71 is a Mini-Myte 41E1 by Humphrey of Kalamazoo, Mich. An exemplary actuator 72 is a Control Line Equipment Inc. Model CO212-0051.0 unit. Most preferably, the anvil body 62, time delay relay 70, pneumatic switch 71 and actuator 72 are fixed to a common baseplate 79 for enhanced stability.

In operation, closing of the foot switch 68 causes an electrical signal to pass along control cable 69 to time delay relay 70. The time delay relay 70 signals the pneumatic switch 71 to direct pressurized air into first control conduit 77 to raise the piston rod 76 and lower the pivot arm 64. While the pivot arm 64 is lowered to the closed position, anvil body 62 heats the sealing strip 63 for the preselected interval to weld the synthetic resin film plys together. After the time selected on the control knob 58 of the time delay relay 70 has elapsed, a second signal is automatically directed to the pneumatic switch to cease introducing air through first control conduit 77 and to instead direct pressurized air through second control conduit 78. The actuator is double-acting, and thereby lowers the piston rod 76 to allow the pivot arm 64 to open. The process is repeated each time the foot switch 68 is closed.

FIGS. 4 and 12 illustrate packaging structure 30 which presents first end 80 second end 81 and includes elongated walls 82 and 84 and short wall 86, all preferably composed of polyethylene. Elongated walls 82, 84 together form bag 88 configured to hold a newspaper in the preferred embodiment. The walls 82, 84 may be formed by folding a single ply or by separate plys which are joined together. Bag 88 is preferably open adjacent first end 80 and wall 84 is slightly longer than wall 82 to form a flap as shown in FIG. 12. Short wall 86 is joined to elongated wall 82 within bag 88 to form pouch 90 with opening 92 at second end 81.

FIG. 3 illustrates bundle 94 made up of a plurality of packaging structures 30. Cardboard header 96 presents an inverted U-shaped configuration and joins the packaging structures 30 at the first ends thereof. Alternatively, the packaging structures 30 could be mounted on plastic headers, or pin sealers, or the packaging structures 30 could be mounted on wire wickets inserted through holes in the bags. The wickets could then be inserted into holes on the platform, or the bags supported on the tines 50*a, b* through the holes 98*a* and 98*b*. As shown herein, a pair of tine-receiving holes 98*a* and 98*b* are defined through bundle 94 just below header 96. Holes 98*a,b* are spaced to register with and receive tines 50*a,b* for coupling bundle 94 with platform 24 adjacent rear side 40 as illustrated in FIG. 5.

In the preferred method of the present invention, an operator of apparatus 20 couples bundle 94, as described above, with platform 24 by inserting tines 50*a,b* through holes 98*a,b*. FIG. 5 illustrates the suspended position for bundle 94. The operator then extends bundle 94 from platform rear side 40 forwardly under platform surface 44 and passes the bundle through open area 38, around front side 42 through open space 36, over holding member 52 and onto platform surface 44 so that pouches 90 and associated pouch openings 92 are supported above platform surface 44 as shown in FIGS. 6 and 7. This presents the pouch openings 92 opening rearwardly as shown in FIG. 7, for example. Holding member 52 prevents bundle 94 and individual packaging structures 30 from sliding back through open space 36 or crossing over the header 96.

FIG. 7 illustrates the loading position for bundle 94. In this position, the operator selects the topmost packaging structure 30*a*, spreads pouch opening 92*a*, and manually inserts article 28*a* into pouch 90*a* through opening 92*a*.

Figure 9:
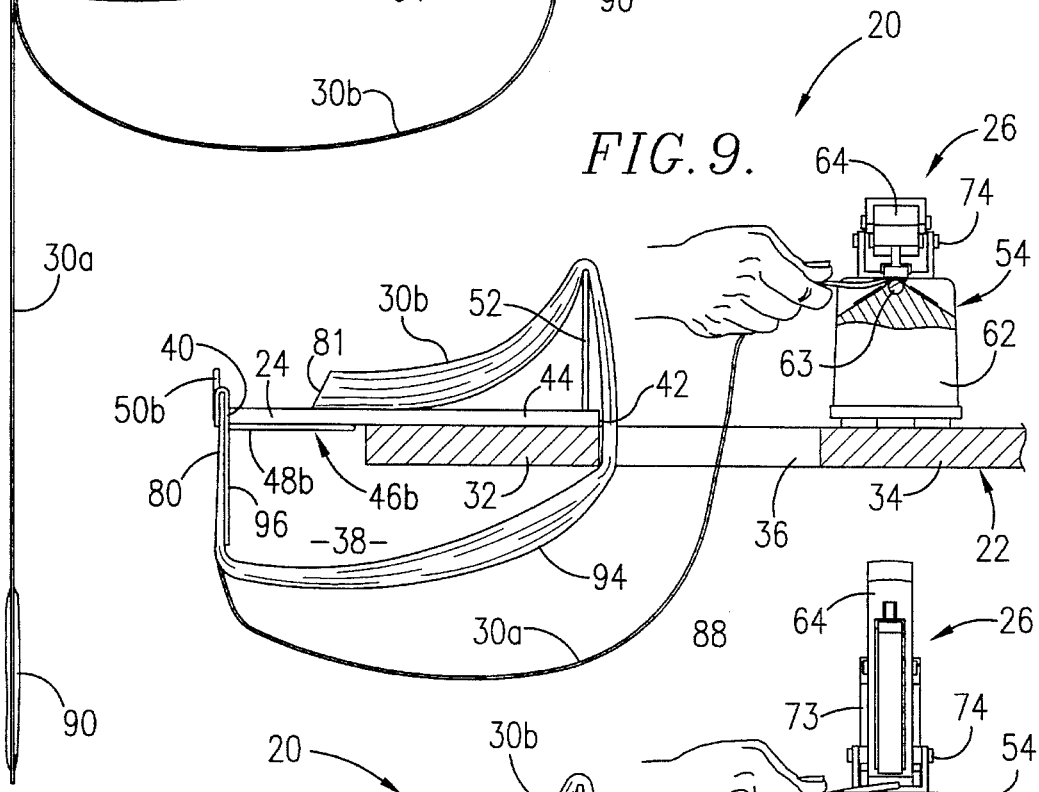
FIG. 9 illustrates the apparatus of FIG. 5 showing the sealing of the opening of the pouch.
Figure 8:
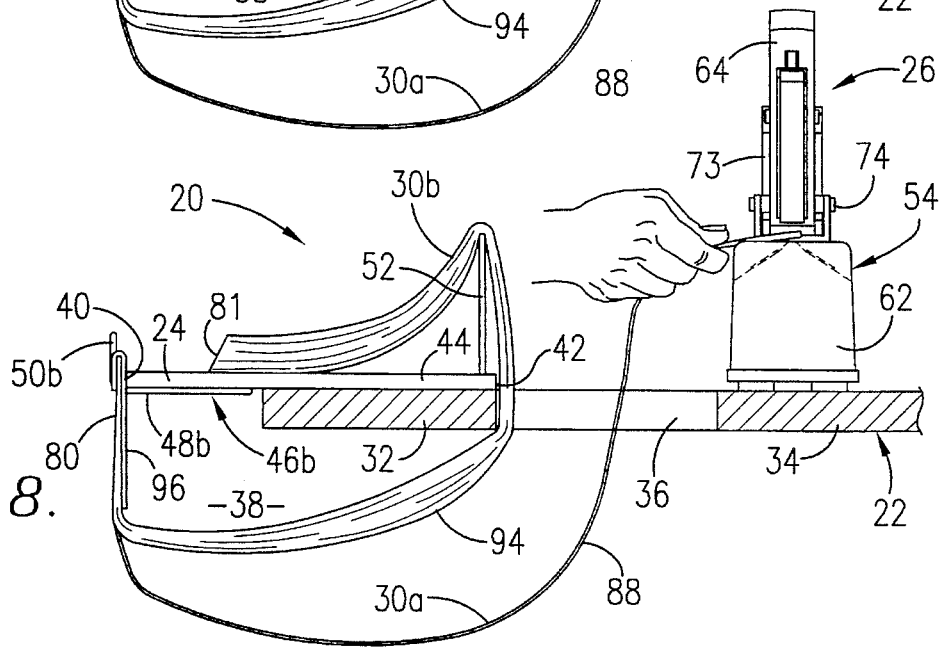
FIG. 8 illustrates the apparatus of FIG. 5 showing the insertion of a pouch into the sealer.

Referring now to FIG. 8, the operator next extends packaging structure 30*a* across open space 36 and places structure 30 in the sealing position as shown, with pouch opening 92 between pivot arm 64 and anvil body 62. The operator then depresses foot switch 68 which causes pivot arm 64 to close, thereby heating strip 63 of anvil body 62, with pouch opening 92 between the pivot arm 64 and seal strip 63 as shown in FIG. 9. This heat seals opening 92. More particularly, this seals packaging structure walls 82, 84 and 86 adjacent second end 80 at weld 100 as illustrated in FIG. 12. The result of this step is that article 28*a* is enclosed within pouch 90*a* to present a completed packaging structure.

Figure 11:
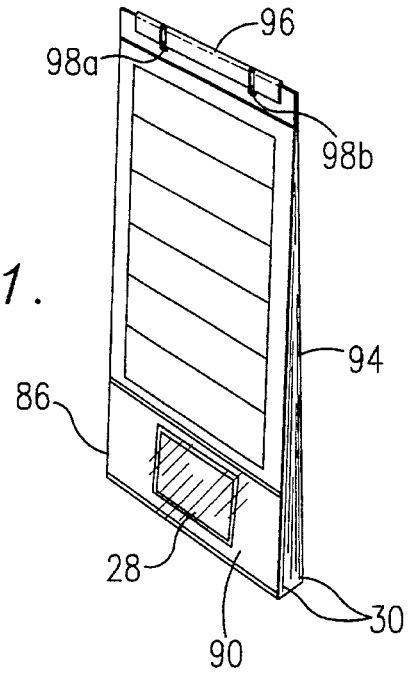
FIG. 11 illustrates a bundle of packaging structures after insertion of articles into the pouches and sealing thereof.
Figure 13:
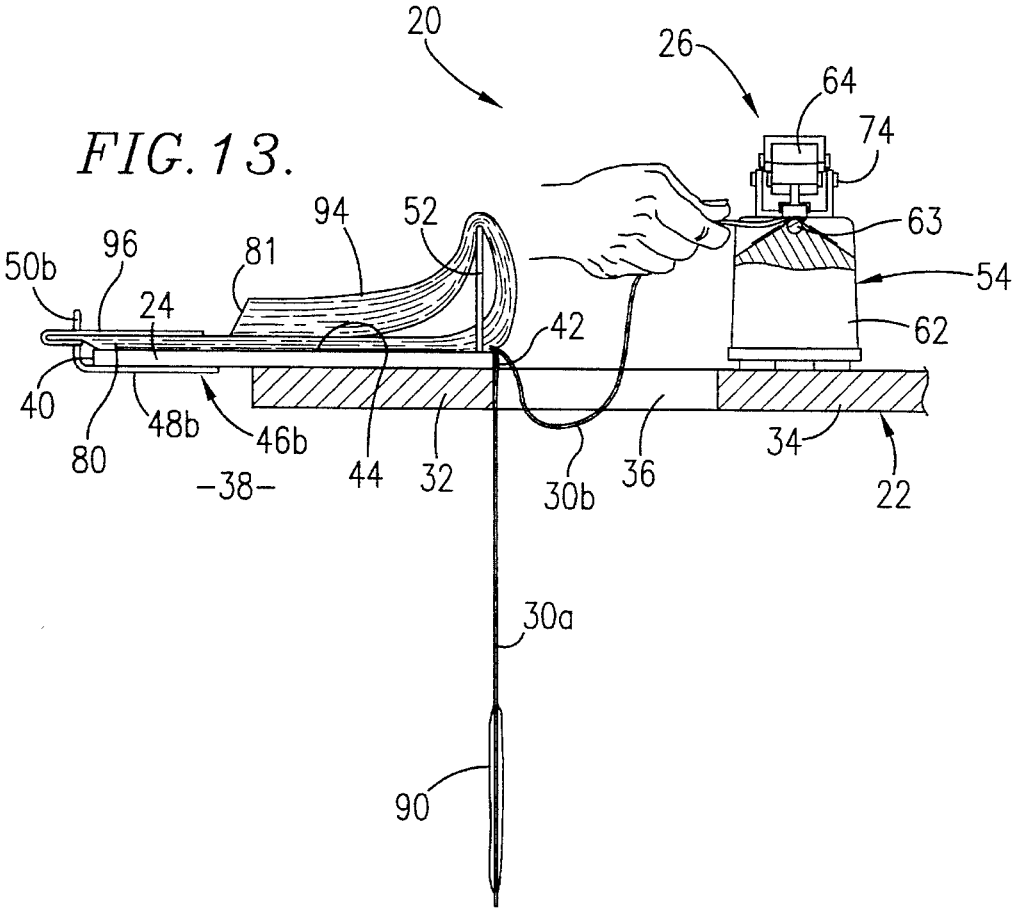
FIG. 13 is a side elevational view in partial section showing an alternative method of the present invention with the bundle initially resting on the platform and showing the sealing of the opening of the pouch.

After the selected period of closure set on the time delay relay 70 has passed, the pivot arm 64 rises and allows structure 30*a* to fall through open space 36 and return to the suspended position (FIG. 10). The inserting and sealing steps described above are repeated until all of the packaging structures in bundle 94 have been sealed with an article in each pouch and the packaging structures 30 all returned to the suspended position, as again illustrated in FIG. 5, to present a completed bundle. The operator then removes the completed bundle 94 (FIG. 11) by lifting bundle 94 from tines 50*a,b*. The operator then puts aside the completed bundle and couples a new bundle with tines 50*a,b*. The steps described above are then repeated.

In an alternate method of the present invention, the packaging structure 30, preferably a bundle 94 of bags 88, is placed on the platform surface 44 with the first end 80 coupled to the platform 24 adjacent the rear side 40. The wall 84 rests on the platform surface 44 and the packaging structure 30 is folded over the holding member 52, preventing the second end 80 from extending to the header 96 when the latter is used to couple together a bundle 94 of bags 88. With the packaging structure 30 thus folded, the opening is oriented toward the rear side 40. The article 28 is manually inserted into the pouch 90 of the selected topmost structure 30 between wall 82 and short wall 86. The packaging structure is then extended to position the opening on the seal strip 93 and the pivot arm 64 closed to seal the pouch 90 and the wall 84 with weld 100. After the second end 81 is sealed, the second end 81 falls off the anvil body 62 and passes through the open space 36 to suspend into open area. The next topmost structure 30 is selected and the foregoing process repeated until articles 28 have been inserted into all pouches 90 and the latter sealed. The bundle 94 is then uncoupled from the platform whereupon a new bundle may be substituted and the entire process repeated.

In the preferred embodiment, completed bundles are shipped to recipients who may fill the bags with desired items. One exemplary use is by newspaper delivery services for insertion of newspapers into respective bags 88. As received by the newspaper services, each article 28 is already sealed in packaging structure 30.

As those skilled in the art will appreciate, the invention hereof encompasses many variations other than the preferred embodiments described herein. The following is claimed as new and desired to be secured by Letters Patent.

We claim:

1. A method of enclosing an article comprising the steps of:

(a) coupling a flexible packaging structure with a platform, said packaging structure presenting first and second, opposed ends and having a pouch defined therein with an opening for receiving an article, said platform presenting front and rear, opposed sides and a platform surface therebetween, (b) inserting an article through said opening into said pouch; and (c) sealing said opening thereby enclosing the article in said pouch, (d) allowing said sealed structure to fall under the influence of gravity from said sealing means step (a) further including the steps of coupling said packaging structure adjacent said first end with said platform adjacent said rear side, and extending said packaging structure from said rear side, under said platform surface, around and above said front side and adjacent said platform surface with said opening above said platform surface for said subsequent inserting step.

2. The method as set forth in claim 1 further including the step of defining said opening in said second end.

3. The method as set forth in claim 1 further including the step of configuring said packaging structure to present an elongated bag having an opening adjacent said first end.

4. The method as set forth in claim 1 further including the step of positioning a sealing device spaced from said front side away from said rear side and using said sealing device for sealing said opening.

5. The method as set forth in claim 4, said sealing device being operable for manual activation, step (c) including the step of manually activating said sealing device for sealing said opening.

6. The method as set forth in claim 4, said sealing device being operable by activating a switch, step (c) including the step of activating said switch for sealing said opening.

7. The method as set forth in claim 1, step (c) including the step of using heat for sealing said opening.

8. The method as set forth in claim 1 further including the step of performing steps (a) , (b) and (c) in succession for a plurality of said packaging structures formed into a bundle and joined at the respective first ends thereof.

9. The method as set forth in claim 1, further including the step of composing said packaging structure of polyethylene.

10. The method as set forth in claim 1, said platform surface including an upright holding member adjacent said rear side for holding said packaging structure with said opening above said platform surface, said extending step including the step of extending said packaging structure over said holding member.

11. The method as set forth in claim 1, said platform including at least one upright tine positioned adjacent said rear side, step (a) further including the step of receiving said tine through said packaging structure adjacent said first end for coupling said packaging structure with said platform.

12. A method of enclosing an article comprising the steps of:

(a) coupling a bundle of flexible packaging structures connected to a common header with a platform, each of said packaging structures including first and second opposed ends, said packaging structures being configured as a bag presenting an open end adjacent said first end and having a pouch defined therein with an opening adjacent said second end, said platform presenting front and rear, opposed sides with a platform surface therebetween, and including a pair of upstanding tines coupled adjacent said rear side, there being an open space adjacent said front side presenting an open area therebeneath, said bundle including joining means for joining said first ends of said structures, and including apertures defined therethrough in registration with said tines for receiving said tines, step (a) further including the step of receiving said tines through said apertures for coupling said bundle with said platform;

(b) extending said bundle from said rear side, under said platform surface, around said front side and onto said platform surface with said openings above said platform surface, (c) selecting the topmost of said packaging structures as a selected structure;

(d) inserting an article into said pouch of said selected structure;

(e) positioning a sealing device forward of said front side with said open space therebetween and using said sealing device for sealing said opening of said selected structure thereby enclosing the article in said pouch of said selected structure;

(f) releasing said selected structure to permit passage of the pouch through said open space for suspending said selected structure under said header; and (g) repeating steps (c), (d) and (e) for all of said structures.

13. The method as set forth in claim 12 further including the step of defining each of said openings in said second ends.

14. The method as set forth in claim 12 further including the step of configuring each of said packaging structures to present bag having an opening adjacent said first end.

15. The method as set forth in claim 12, said sealing device being operable for manual activation, step (e) including the step of manually activating said sealing device for sealing said opening.

16. The method as set forth in claim 12, said sealing device being operable by activating a switch, step (e) including the step of activating said switch for sealing said opening.

17. The method as set forth in claim 12, step (e) including the step of using heat for sealing said opening.

18. The method as set forth in claim 12, further including the step of composing said packaging structures of polyethylene.

19. The method as set forth in claim 12, further comprising: a support surface including an upright holding member adjacent said rear side for holding said packaging structures with said opening above said support surface, step (b) including the step of extending said packaging structure over said holding member.

20. The method as set forth in claim 12, said platform including a pair of upright tines positioned adjacent said rear side, step (a) further including the step of receiving said tines through said joining means for coupling said packaging structure with said platform.

21. A method for enclosing an article comprising the steps of:

(a) coupling a plurality of flexible packaging structures with a platform, each of said packaging structures including first and second opposed ends, said packaging structures being configured as a bag presenting an open end adjacent said first end and having a pouch defined therein with an opening adjacent said second end, said platform presenting front and rear, opposed sides with a platform surface therebetween, and including means for coupling said bags at the first ends thereof to the rear side of said platform, there being an open space adjacent said front side presenting an open area therebetween, (b) extending said plurality of packaging structures from said rear side under said platform, through said open space and onto said platform surface, and folding said plurality of packaging structures to orient said second end toward said rear side;

(c) selecting the topmost of said packaging structures as a selected structure;

(d) inserting an article into said pouch of said selected structure;

(e) positioning a sealing device forward of said front side with said open space therebetween and using said sealing device for sealing said opening of said selected structure thereby enclosing the article in said pouch of said selected structure;

(f) releasing said selected structure to permit passage of said pouch through said open space; and (g) repeating steps (c) , (d) and (e) for all of said structures.

22. The method as set forth in claim 21 further including the step of defining each of said openings in said second ends.

23. The method as set forth in claim 21 further including the step of configuring each of said packaging structures to present bag having an opening adjacent said first end.

24. The method as set forth in claim 21, said sealing device being operable for manual activation, step (e) including the step of manually activating said sealing device for sealing said opening.

25. The method as set forth in claim 21, said sealing device being operable by activating a switch, step (e) including the step of activating said switch for sealing said opening.

26. The method as set forth in claim 21, step (e) including the step of using heat for sealing said opening.

27. The method as set forth in claim 21, further including the step of composing said packaging structures of polyethylene.

28. The method as set forth in claim 21, further comprising: a support surface including an upright holding member adjacent said rear side for holding said packaging structures with said opening above said support surface, step (b) including the step of extending said packaging structure over said holding member.

29. The method as set forth in claim 21, said platform including a pair of upright tines positioned adjacent said rear side, step (a) further including the step of receiving said tines through respective holes in said packaging structures for coupling said plurality of packaging structures to said platform.

30. An apparatus for enclosing an article in a packaging structure presenting first and second, opposed ends and having a pouch defined therein with an opening for receiving an article, said apparatus comprising:

a platform presenting front and rear, opposed sides with a platform surface therebetween;

sealing means for sealing a packaging structure; and framework means for positioning said sealing means forwardly of said front side with an open space between said sealing means and said front side and for positioning said platform surface with an open area thereunder, said platform including coupling means for coupling the packaging structure adjacent the first end thereof with said platform adjacent said rear side, said platform and framework cooperatively presenting means for supporting the packaging structure extending from said rear side, under said platform surface through said open area, around said front side through said open space and onto said platform surface with the pouch opening supported above a support surface, for allowing insertion of an article into the pouch through the opening while supported above said support surface, and thereafter, for positioning the pouch opening for sealing thereof by said sealing means thereby enclosing the article.

31. The apparatus as set forth in claim 30, said framework means including a planar body having said open space defined therein.

32. The apparatus as set forth in claim 31, said framework means including a table having a tabletop with said open space defined therein.

33. The apparatus as set forth in claim 30, said coupling means including at least one upstanding tine positioned adjacent said rear side and configured for recession through the packaging structure adjacent the first end.

34. The apparatus as set forth in claim 30, further including an upright holding member coupled with said support surface adjacent said front side and configured for engaging the packaging structure between the pouch and the first end thereof.

35. The apparatus as set forth in claim 30, said sealing means including means for heat sealing the pouch opening.

36. The apparatus as set forth in claim 30, said sealing means including a switch-activatable sealing mechanism operably coupled with a switch for activating said mechanism.

37. The apparatus as set forth in claim 36, said sealing means including a pivot arm and an anvil body, and further including timing means coupled to activating means for closing said pivot arm onto said anvil for a preselected duration.

* * * * *